US006774324B2

(12) United States Patent
Wong

(10) Patent No.: US 6,774,324 B2
(45) Date of Patent: Aug. 10, 2004

(54) SWITCH AND PRODUCTION THEREOF

(75) Inventor: Marvin Glenn Wong, Woodland Park, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/317,597

(22) Filed: Dec. 12, 2002

(65) Prior Publication Data

US 2004/0112725 A1 Jun. 17, 2004

(51) Int. Cl.[7] ..... H01H 29/00
(52) U.S. Cl. ..... 200/182; 200/193
(58) Field of Search ..... 200/182, 185, 200/188, 193, 214, 233, 221, 227, 228; 219/209, 210, 528, 543, 549; 310/328, 363, 365

(56) References Cited

U.S. PATENT DOCUMENTS

| | | | |
|---|---|---|---|
| 2,312,672 | A | 3/1943 | Pollard, Jr. |
| 2,564,081 | A | 8/1951 | Schilling |
| 3,430,020 | A | 2/1969 | Tomkewitsch et al. |
| 3,529,268 | A | 9/1970 | Rauterberg |
| 3,600,537 | A | 8/1971 | Twyford |
| 3,639,165 | A | 2/1972 | Rairden, III |
| 3,657,647 | A | 4/1972 | Bausman et al. |
| 4,103,135 | A | 7/1978 | Gomez et al. |
| 4,200,779 | A | 4/1980 | Zakurdaev et al. |
| 4,238,748 | A | 12/1980 | Goullin et al. |
| 4,245,886 | A | 1/1981 | Kolodzey et al. |
| 4,336,570 | A | 6/1982 | Brower |
| 4,419,650 | A | 12/1983 | John |
| 4,434,337 | A | 2/1984 | Becker |
| 4,475,033 | A | 10/1984 | Willemsen et al. |
| 4,505,539 | A | 3/1985 | Auracher et al. |
| 4,582,391 | A | 4/1986 | Legrand |

(List continued on next page.)

FOREIGN PATENT DOCUMENTS

| | | | |
|---|---|---|---|
| EP | 0593836 | A1 | 4/1994 |
| FR | 2418539 | | 9/1979 |
| FR | 2458138 | | 12/1980 |
| FR | 2667396 | | 4/1992 |
| JP | SHO 36-18575 | | 10/1961 |
| JP | SHO 47-21645 | | 10/1972 |
| JP | 62-276838 | | 12/1987 |
| JP | 63-294317 | | 12/1988 |
| JP | 8-125487 | | 5/1996 |
| JP | 9161640 | A | 6/1997 |
| WO | WO99/46624 | | 12/1999 |

OTHER PUBLICATIONS

Marvin Glenn Wong, "Laser Cut Channel Plate For A Switch", Patent application (SN: 10/317932 filed Dec. 12, 2002), 11 pages of specification, 5 pages of claims, 1 page of abstract, and 4 sheets of formal drawings (Fig. 1–10).
Marvin Glenn Wong, "A Piezoelectrically Actuated Liquid Metal Switch", May 2, 2002, patent application (pending), 12 pages of specification, 5 pages of claims, 1 page of abstract, and 10 sheets of drawings (Figs. 1–10).
Joonwon Kim et al., "A Micromechanical Switch with Electrostatically Driven Liquid–Metal Droplet", 4 pages.
Jonathan Simon et al., "A Liquid–Filled Microrelay with a Moving Mercury Microdrop", Journal of Microelectromechanical Systems, vol. 6, No. 3, Sep. 1977, pp. 208–216.
TDB–ACC–NO: NBB406827, "Integral Power Resistors For Aluminum Substrate", IBM Technical Disclosure Bulletin, Jun. 1984, US, vol. 27, Issue No. 18, p. 827.

*Primary Examiner*—Michael Friedhofer
*Assistant Examiner*—Lisa Klaus

(57) ABSTRACT

A switch and production thereof. The switch may be produced by (1) depositing a liquid switching element on a substrate, (2) positioning a channel plate adjacent the substrate, (3) moving the channel plate toward the substrate, the liquid switching element wetting to the channel plate, and a portion of the liquid switching element isolated into at least one waste chamber in the channel plate; and (4) closing the channel plate against the substrate.

11 Claims, 5 Drawing Sheets

U.S. PATENT DOCUMENTS 4,628,161 A 12/1986 Thackrey
4,652,710 A 3/1987 Karnowsky et al.
4,657,339 A 4/1987 Fick
4,742,263 A 5/1988 Harnden, Jr. et al.
4,786,130 A 11/1988 Georgiou et al.
4,797,519 A 1/1989 Elenbaas
4,804,932 A 2/1989 Akanuma et al.
4,988,157 A 1/1991 Jackel et al.
5,278,012 A 1/1994 Yamanaka et al.
5,415,026 A 5/1995 Ford
5,502,781 A 3/1996 Li et al.
5,644,676 A 7/1997 Blomberg et al.
5,675,310 A 10/1997 Wojnarowski et al.
5,677,823 A 10/1997 Smith
5,751,074 A 5/1998 Prior et al.
5,751,552 A 5/1998 Scanlan et al.
5,828,799 A 10/1998 Donald
5,841,686 A 11/1998 Chu et al.
5,849,623 A 12/1998 Wojnarowski et al.
5,874,770 A 2/1999 Saia et al.
5,875,531 A 3/1999 Nellissen et al.
5,886,407 A 3/1999 Mossbeck
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A 11/1999 Yagi
6,021,048 A 2/2000 Smith
6,180,873 B1 1/2001 Bitko
6,201,682 B1 3/2001 Mooij et al.
6,207,234 B1 3/2001 Jiang
6,212,308 B1 4/2001 Donald
6,225,133 B1 5/2001 Yamamichi et al.
6,278,541 B1 8/2001 Baker
6,304,450 B1 10/2001 Dibene, II et al.
6,320,994 B1 11/2001 Donald et al.
6,323,447 B1 * 11/2001 Kondoh et al. ..... 200/182
6,351,579 B1 2/2002 Early et al.
6,356,679 B1 3/2002 Kapany
6,373,356 B1 * 4/2002 Gutierrez et al. ..... 335/47
6,396,012 B1 5/2002 Bloomfield
6,396,371 B2 5/2002 Streeter et al.
6,408,112 B1 6/2002 Bartels
6,446,317 B1 9/2002 Figueroa et al.
6,453,086 B1 9/2002 Tarazona
6,470,106 B2 10/2002 McClelland et al.
6,487,333 B2 11/2002 Fouquet
6,501,354 B1 12/2002 Gutierrez et al.
6,512,322 B1 1/2003 Wong et al.
6,515,404 B1 2/2003 Wong
6,516,504 B2 2/2003 Schaper
6,559,420 B1 * 5/2003 Zarev ..... 219/209
6,633,213 B1 10/2003 Dove
2002/0037128 A1 3/2002 Burger et al.
2002/0145197 A1 10/2002 Yong
2002/0150323 A1 10/2002 Nishida et al.
2002/0168133 A1 11/2002 Saito
2003/0035611 A1 2/2003 Shi

* cited by examiner

SWITCH AND PRODUCTION THEREOF

BACKGROUND

Liquid metal micro-switches (LIMMS) have been developed to provide reliable switching capability using compact hardware (e.g., on the order of microns). The small size of LIMMS make them ideal for use in hybrid circuits and other applications where smaller sizes are desirable. Besides their smaller size, advantages of LIMMS over more conventional switching technologies include reliability, the elimination of mechanical fatigue, lower contact resistance, and the ability to switch relatively high power (e.g., about 100 milli-Watts) without overheating, to name just a few.

According to one design, LIMMS have a main channel partially filled with a liquid metal. The liquid metal may serve as the conductive switching element. Drive elements provided adjacent the main channel move the liquid metal through the main channel, actuating the switching function.

During assembly, the volume of liquid metal must be accurately measured and delivered into the main channel. Failure to accurately measure and/or deliver the proper volume of liquid metal into the main channel could cause the LIMM to fail or malfunction. For example, too much liquid metal in the main channel could cause a short. Not enough liquid metal in the main channel may prevent the switch from making a good connection.

The compact size of LIMMS makes it especially difficult to accurately measure and deliver the liquid metal into the main channel. Even variations in the tolerance of the machinery used to deliver the liquid metal may introduce error during the delivery process. Variations in the dimensions of the main channel itself may also introduce volumetric error.

SUMMARY OF THE INVENTION

An embodiment of the invention is a switch comprising a channel plate having a main channel and at least one waste chamber formed therein. The switch may also comprise a substrate having at least one contact pad. A liquid switching element is deposited on the at least one contact pad. A portion of the liquid switching element is isolated from the main channel into the at least one waste chamber when the channel plate is assembled to the substrate.

Another embodiment of the invention is a method for assembling a switch, comprising the steps of: depositing a liquid switching element on a substrate; positioning a channel plate adjacent the substrate; moving the channel plate toward the substrate; isolating a portion of the liquid switching element from a main channel in the channel plate into a waste chamber in the channel plate.

Yet other embodiments are also disclosed.

DESCRIPTION OF THE DRAWINGS

Illustrative and presently preferred embodiments of the invention are shown in the drawings, in which:

FIG. 1(*b*) is a perspective view of the switch of FIG. 1(*a*), shown in a second state;

FIG. 2(*b*) is a plan view of a substrate used to produce the switch according to one embodiment of the invention;

DESCRIPTION

Figure 1A:
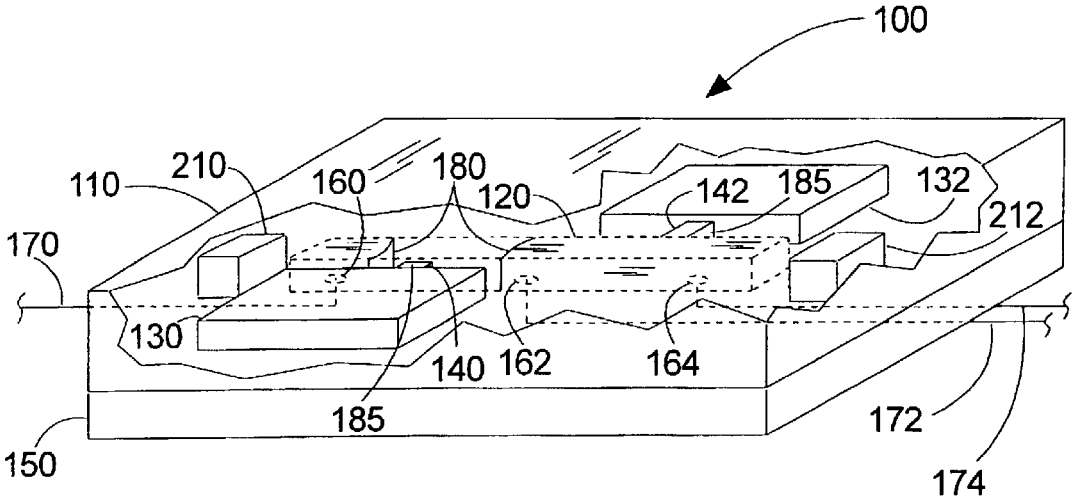
FIG. 1(*a*) is a perspective view of one embodiment of a switch, shown in a first state.
Figure 1B:
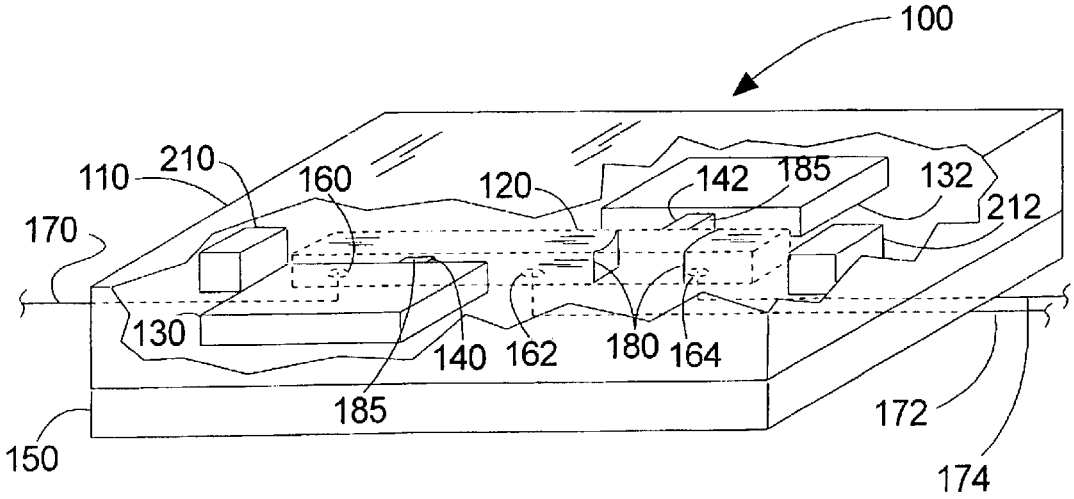

One embodiment of a switch 100 is shown and described according to the teachings of the invention with respect to FIG. 1(*a*) and FIG. 1(*b*). Switch 100 comprises a channel plate 110 defining a portion of a main channel 120, drive chambers 130, 132, and subchannels 140, 142 fluidically connecting the drive chambers 130, 132 to the main channel 120. The channel plate 110 is assembled to a substrate 150, which further defines the main channel 120, drive chambers 130, 132, and subchannels 140, 142.

In one embodiment, the channel plate 110 is manufactured from glass, although other suitable materials may also be used (e.g., ceramics, plastics, a combination of materials). The substrate 150 may be manufactured from a ceramic material, although other suitable materials may also be used.

Channels may be etched into the channel plate 110 (e.g., by sand blasting) and covered by the substrate 150, thereby defining the main channel 120, drive chambers 130, 132, and subchannels 140, 142. Other embodiments for manufacturing the channel plate 110 and substrate 150 are also contemplated as being within the scope of the invention.

Of course it is understood that the main channel 120, drive chambers 130, 132, and/or subchannels 140, 142 may be defined in any suitable manner. For example, the main channel 120, drive chambers 130, 132, and/or subchannels 140, 142 may be entirely formed within either the channel plate 110 or the substrate 150. In other embodiments, the switch may comprise additional layers, and the main channel 120, drive chambers 130, 132, and/or subchannels 140, 142 may be partially or entirely formed through these layers.

It is also understood that the switch 100 is not limited to any particular configuration. In other embodiments, any suitable number of main channels 120, drive chambers 130, 132, and/or subchannels 140, 142 may be provided and suitably linked to one another. Similarly, the main channels 120, drive chambers 130, 132, and/or subchannels 140, 142 are not limited to any particular geometry. Although according to one embodiment, the main channels 120, drive chambers 130, 132, and/or subchannels 140, 142 have a semi-elliptical cross section, in other embodiments, the cross section may be elliptical, circular, rectangular, or any other suitable geometry.

According to the embodiment shown in FIG. 1(*a*) and FIG. 1(*b*), switch 100 may also comprise a plurality of electrodes or contact pads 160, 162, 164 which are exposed to the interior of the main channel 120. Leads 170, 172, and 174 may be provided through the substrate 150 and may carry electrical current to/from the contact pads 160, 162, 164 during operation of the switch 100.

Of course the switch 100 may be provided with any number of contact pads, including more or less than shown and described herein. The number of contact pads may depend at least to some extent on the intended use of the switch 100.

The main channel 120 is partially filled with a liquid switching element 180. In one embodiment, the liquid switching element 180 is a conductive fluid (e.g., mercury (Hg)). As such, the liquid switching element 180 may serve as a conductive path between the contact pads 160, 162 or contact pads 162, 164. Alternatively, an opaque fluid may be used for an optical switch (not shown). The opaque fluid is used to block and unblock optical paths, as will be readily understood by one skilled in the art after having become familiar with the teachings of the invention.

The subchannels 140, 142 may be at least partially filled with a driving fluid 185. Preferably, the driving fluid 185 is a non-conductive fluid, such as an inert gas or liquid. The driving fluid 185 may be used to move the liquid switching element 180 within the main channel 120.

Figure 2A:
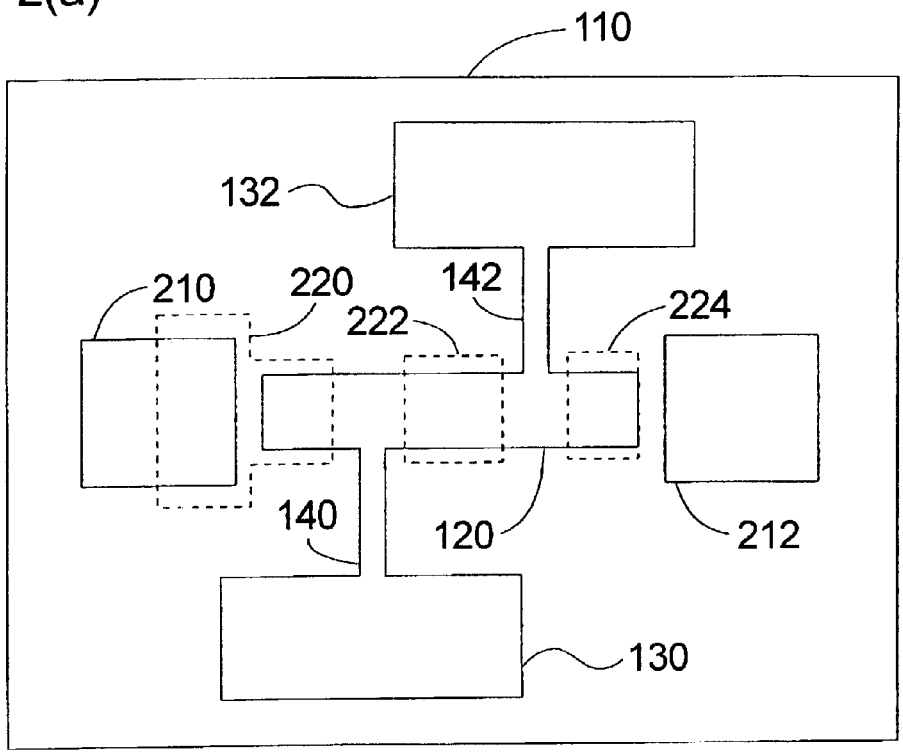
FIG. 2(*a*) is a plan view of a channel plate used to produce the switch according to one embodiment of the invention.
Figure 2B:
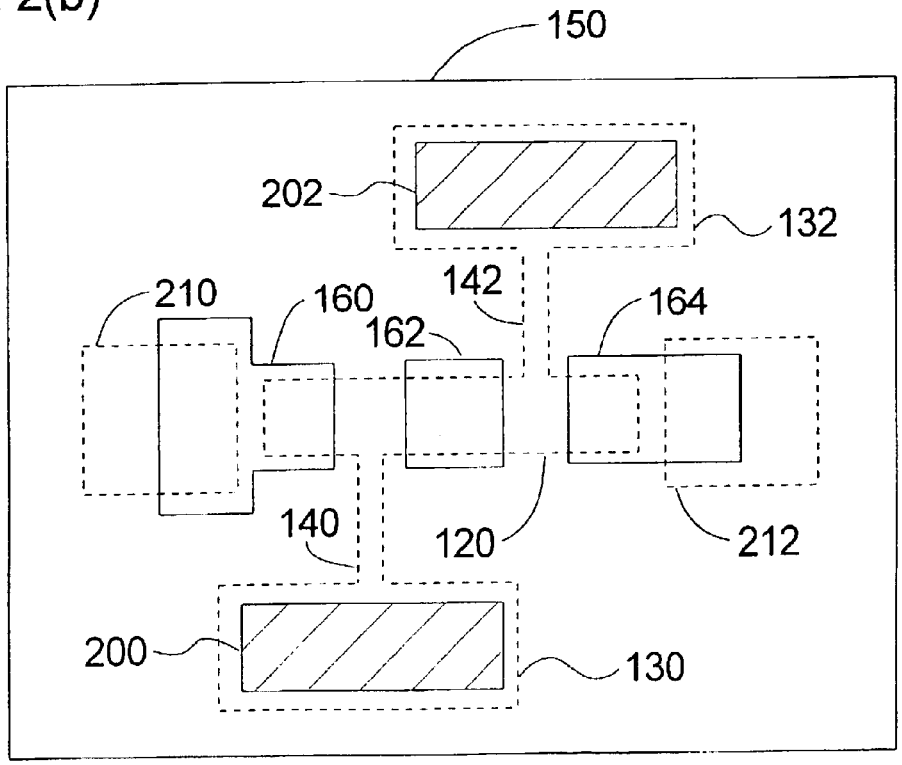

Drive elements 200, 202 (FIG. 2(*b*)) may be provided in drive chambers 130, 132. Drive elements 200, 202 may comprise, for example, heat-producing means (e.g., thin-film resistors) which heat the driving fluid 185 and cause it to expand. Other embodiments, now known or later developed, are also contemplated as being within the scope of the invention. For example, drive elements 200, 202 may comprise acoustic or pump means, to name only a few. In any event, the drive elements 200, 202 can be operated to force the driving fluid 185 (see FIG. 1(*a*) and FIG. 1(*b*)) into the main chamber 120, causing the liquid switching element 180 to "part" and move within the main channel 120.

By way of illustration, switch 100 is shown in a first state in FIG. 1(*a*) wherein the liquid switching element 180 makes a conductive path between contact pads 162 and 164. Drive element 202 may be operated to effect a change in state of switch 100, as shown in FIG. 1(*b*). Operation of the drive element 202 (FIG. 2(*b*)) causes the liquid switching element 180 to move toward the other end of the main channel 120, wherein the liquid switching element 180 makes a conductive path between contact pads 160 and 162. Similarly, drive element 200 (FIG. 2(*b*)) can be operated to change the state of the switch 100 back to the first state.

Suitable modifications to switch 100 are also contemplated as being within the scope of the invention, as will become readily apparent to one skilled in the art after having become familiar with the teachings of the invention. For example, the present invention is also applicable to optical micro-switches (not shown). Also see, for example, U.S. Pat. No. 6,323,447 of Kondoh et al. entitled "Electrical Contact Breaker Switch, Integrated Electrical Contact Breaker Switch, and Electrical Contact Switching Method", and U.S. patent application Ser. No. 10/137,691 and filed on May 2, 2002 of Marvin Wong entitled "A Piezoelectrically Actuated Liquid Metal Switch", each hereby incorporated by reference for mall that is disclosed.

The foregoing description of one embodiment of switch 100 is provided in order to better understand its operation. It should also be understood that the present invention is applicable to any of a wide range of other types and configurations of switches, now known or that may be developed in the future.

Switch 100 may comprise a channel plate 110 and a substrate 150, as shown in more detail according to one embodiment in FIG. 2(*a*) and FIG. 2(*b*), respectively. Note that the channel plate 110 is shown in FIG. 2(*a*) as it appears from the top looking through the channel plate 110. Substrate 150 is shown in FIG. 2(*b*) as it appears from the side (e.g., top) that abuts the channel plate 110. In addition, the main channel 120, subchannels 140, 142, waste chambers 210, 212, and heater chambers 130, 132 are outlined in FIG. 2(*b*) to indicate their presence in embodiments where at least a portion of these features are provided in the substrate 150, as discussed above.

Channel plate 110 has a main channel 120 and waste chambers 210, 212 formed therein. Substrate 150 has contact pads 160, 162, 164. Contact pads 160, 162, 164 may be made of a wettable material. Where the contact pads 160, 162, 164 serve to make electrical connections, contact pads 160, 162, 164 are made of a conductive material, such as metal.

Contact pads 160, 162, 164 are spaced apart from one another. Preferably, subchannels 140, 142 open to the main chamber 120 in the space provided between the contact pads 160, 162, 164. Such an arrangement serves to enhance separation of the liquid switching element 180 during switching operations.

Figure 3:
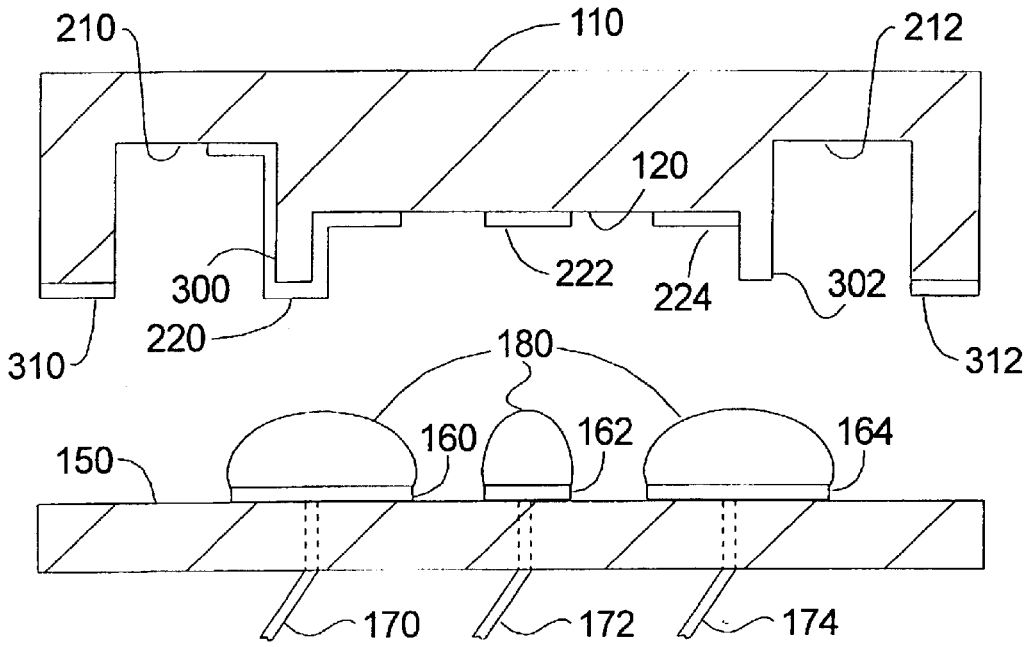
FIG. 3 is a side view of the channel plate positioned adjacent the substrate, showing a liquid switching element deposited on the substrate.

A liquid switching element 180 may be deposited on the contact pads 160, 162, 164, as shown according to one embodiment in FIG. 3. Preferably, the liquid switching element 180 is more than needed to fulfill a switching function. An excess portion of the liquid switching element discharges from the main channel 120 into the waste chambers 210, 212 when the channel plate 110 is assembled to the substrate 150, as will be discussed in more detail below.

The main channel 120 may be isolated from the waste chambers 210, 212 by dams or barriers 300, 302 on the channel plate 110. Barriers 300, 302 serve to isolate the liquid switching element 180 into the main channel 120 and the waste chambers 210, 212 during assembly. See for example, the illustration of FIG. 4 through FIG. 7 discussed below. Barriers 300, 302 also serve to isolate the excess liquid switching element 180 in the waste chambers 210, 212 after assembly (e.g., during operation of the switch 100). Accordingly, the waste chambers 210, 212 do not need to be separately sealed, but may be if so desired.

Seal belts 220, 222, 224 may be provided on the channel plate 110 to promote wetting of the liquid switching element 180 to the channel plate 110. Seal belts 220, 222, 224 are illustrated in FIG. 2(*a*) in outline form to better show their position relative to main channel 120 and waste chambers 210, 212 (i.e., overlaying the channels).

Seal belts 220, 222, 224 are preferably made of a wettable material. Suitable materials may include metal, metal alloys, to name only a few. In one embodiment, seal belts 220, 222, 224 are made of one or more layers of thin-film metal. For example, the seal belts 220, 222, 224 may comprise a thin layer (e.g., about 1000 Å) of chromium (Cr), a thin layer (e.g., about 5000 Å) of platinum (Pt), and a thin layer (e.g., about 1000 Å) of gold (Au). The outermost layer of gold quickly dissolves when it comes into contact with a mercury (Hg) liquid switching element 180, and the mercury forms an alloy with the layer of platinum. Accordingly the liquid switching element 180 readily wets to the seal belts 220, 222, 224.

It is noted that one of the seal belts (e.g., 220) preferably extends across one of the barriers (e.g., 300) into the adjacent waste chamber (e.g., 210). Therefore, the liquid switching element 180 wets to the barrier 300 and excess liquid switching element 180 is readily discharged into the waste chamber 210 during assembly (see FIG. 4).

It is also noted that one of the seal belts (e.g., 224) preferably does not extend across one of the barriers (e.g., 302) into the adjacent waste chamber (e.g., 212). The liquid switching element 180 does not readily wet to the barrier 302 without a seal belt. Accordingly, at least a portion of the liquid switching element 180 is forced into the main channel 120 toward contact pad 162 during assembly (see FIG. 5).

Figure 7:
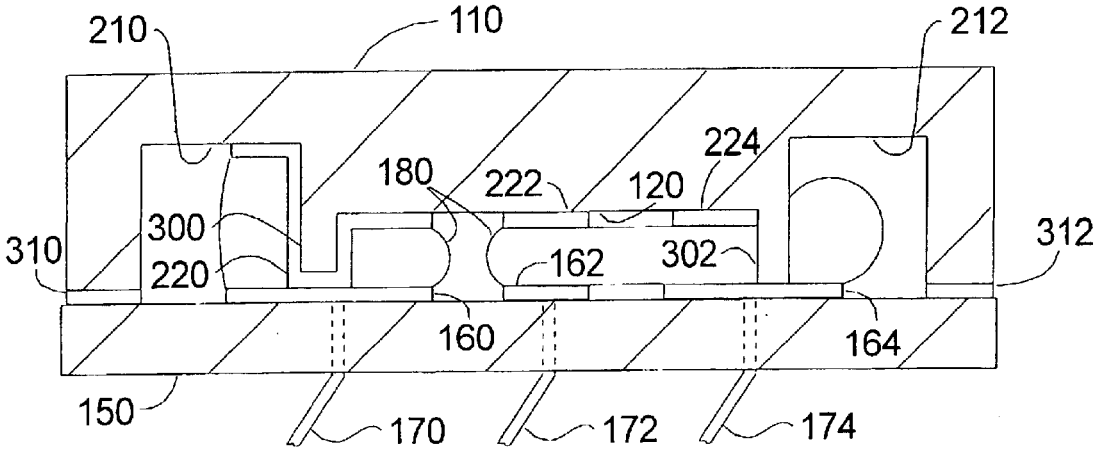
FIG. 7 is a side view of the channel plate assembled to the: substrate, shown in a first state.
Figure 8:
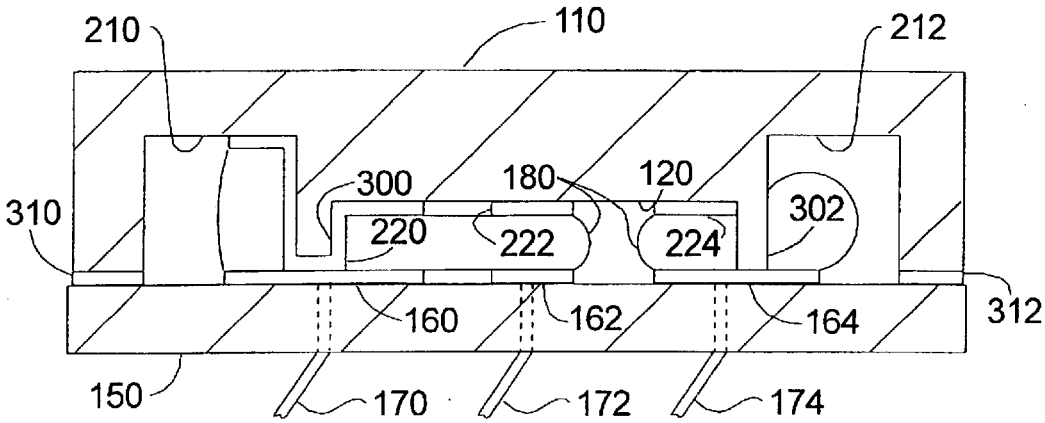
FIG. 8 is another side view of the channel plate assembled to the substrate, shown in a second state.

Following assembly, the desired amount of liquid switching element 180 remains in the main channel 120 as shown in FIG. 7 and FIG. 8. The liquid switching element 180 remaining in the main channel 120 can be used to effect a change of state in the switch 100, as described above. Excess of the liquid switching element 180 is isolated from the main channel 120 in the waste chambers 210, 212.

Preferably, waste chambers 210, 212 are isolated from the main channel 120 by barriers 300, 302. Waste chambers may also be sealed (e.g., around the outer perimeter of the switch 100). For example, seals 310, 312 (e.g., made of CYTOP®, commercially available from Asahi Glass Company, Ltd (Tokyo, Japan)) may be provided on the outer perimeter of the channel plate 110 and/or substrate 150. Excess liquid switching element 180 therefore remains in the waste chambers 210, 212. Alternatively, excess liquid switching element 180 may be removed from the waste chambers 210, 212, as desired.

Switch. 100 may be produced according to one embodiment of the invention as follows. Liquid switching element 180 is deposited on the substrate 150, as illustrated in FIG. 3. In one embodiment, liquid switching element 180 is deposited on each of the contact pads 160, 162, 164. Although liquid switching element 180 need not be accurately measured, suitable volumes of deposited liquid switching element 180 may form "swells" on the contact pads 160, 162, 164, but preferably does not run over the sides of the contact pads 160, 162, 164 onto the substrate 150.

The channel plate 110 may be positioned adjacent the substrate 150. Although channel plate 110 may be positioned adjacent the substrate 150 prior to depositing the liquid switching element 180, the invention is not limited to this sequence. The channel plate 110 may then be moved toward the substrate 150.

Figure 4:
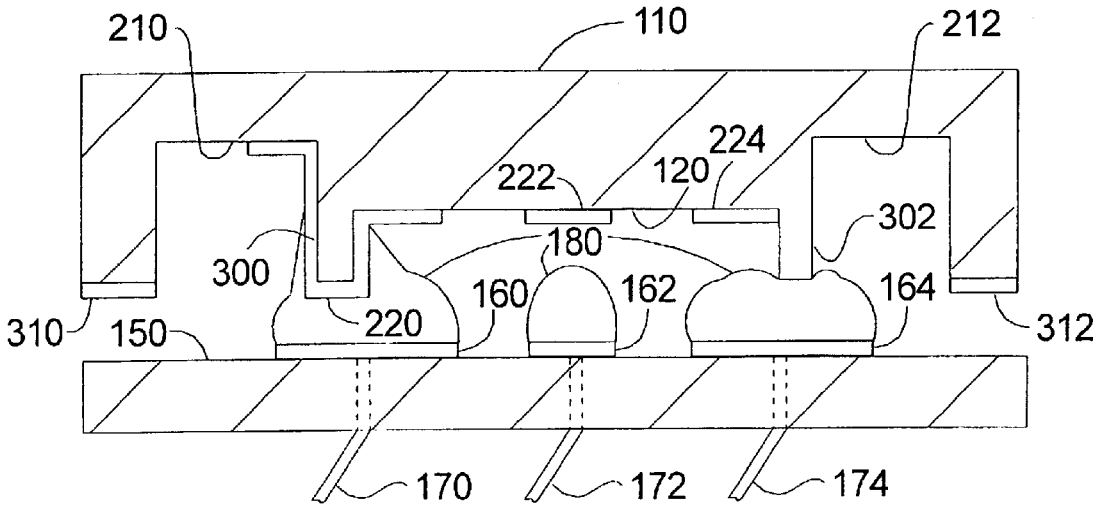
FIG. 4 is a side view of the channel plate and substrate moved toward one another, showing the liquid switching element wet to the channel plate.

As the channel plate 110 is moved toward substrate 150, the liquid switching element 180 on contact pads 160, 164 comes into contact with barriers 300, 302 on the channel plate 110, as shown in FIG. 4. In one embodiment, liquid switching element 180 on contact pad 160 wets to the seal belt 220 extending across the barrier 300 from the main channel 120 into the waste chamber 210. Accordingly, excess liquid switching element 180 is discharged into waste chamber 210 and is not forced into the main channel 120.

Figure 5:
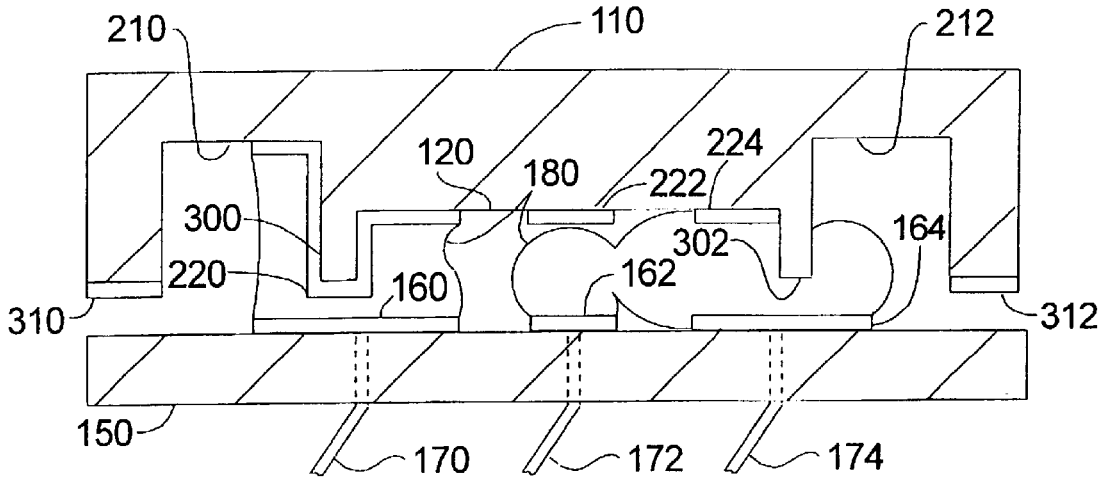
FIG. 5 is a side view of the channel plate and substrate moved closer to one another, showing the liquid switching element discharging into the waste chambers.

Also according to this embodiment, the liquid switching element 180 on contact pad 164 does not wet to barrier 302, as it is not provided with a seal belt 220 extending into the waste chamber 212. Instead, the hydrostatic pressure of the liquid switching element 180 increases as barrier 302 is moved against it, forcing liquid switching element 180 into the main channel 120 and into contact with the liquid switching element 180 on contact pad 162, as shown in FIG. 4 and FIG. 5. A portion of the liquid switching element 180 (i.e., excess) may also be discharged into the waste chamber 212.

Preferably, the assembly process comprises pausing or slowing movement of the channel plate 110 toward the substrate 150 for a time sufficient to allow liquid switching element 180 to equilibrate. The surface tension of the liquid switching element 180 causes the liquid switching element 180 to flow toward an area having a greater, cross-sectional area (i.e., the waste chambers 210, 212). Movement of the liquid switching element 180 is enhanced by wettable areas (i.e., the contact pads 160, 164 and seal belts 220, 224).

Figure 6:
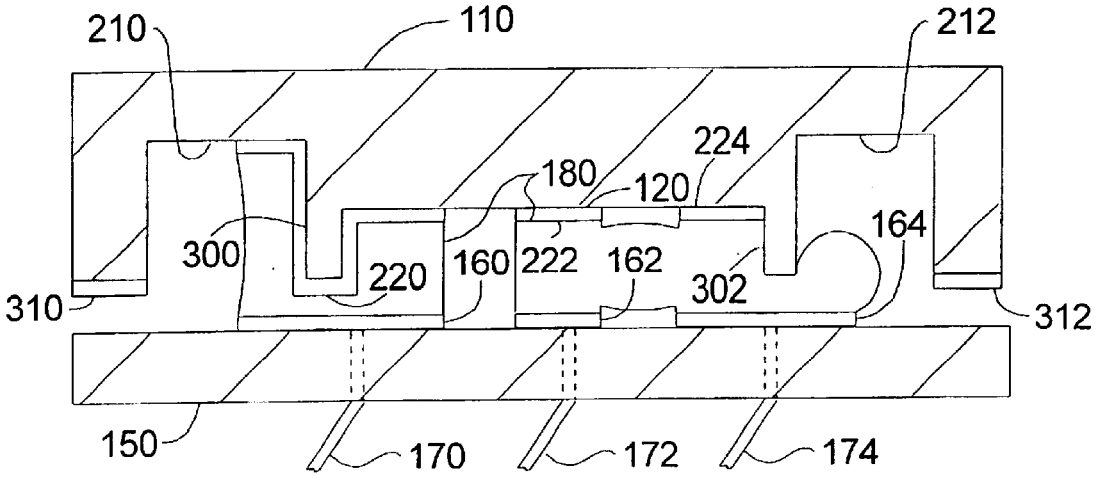
FIG. 6 is a side view of the channel plate and substrate, showing the liquid switching element in equilibrium.

The liquid switching element 180 is shown in equilibrium between the waste chambers 210, 212 and main channel 120 in FIG. 6. According to this embodiment, the liquid switching element 180 on contact pad 160 extends substantially perpendicular to the substrate 150 and is aligned between the edge of contact pad 160 and the edge of seal belt 220. Liquid switching element 180 on contact pad 164 has merged with liquid switching element 180 on contact pad 162. The liquid switching element 180 wets to the contact pads 162, 164 and seal belts 222, 224, and has "pulled away" from the channel plate 110 and substrate 150 between the contact pads 162, 164 and seal belts 222, 224. Excess liquid switching element 180 is discharged or otherwise removed into the waste chambers 210, 212.

The channel plate 110 may then be closed against the substrate 150, as shown in FIG. 7. Liquid switching element 180 may be forced out from under the barriers 300, 302 and into the main channel 120 and waste chamber 210, 212. The volume of liquid switching element 180 forced out from under barriers 300, 302 may bulge toward the air space between the liquid switching element in main channel 120 (as illustrated in FIG. 7), but is not forced so far into the main channel 120 that the switch is shorted.

The channel plate 110 may be connected to the substrate 150 in any suitable manner. In one embodiment, an adhesive is used to connect the channel plate 110 to the substrate 150. In another embodiment, screws or other suitable fasteners may be used. Barriers 300, 302 serve to isolate the main channel 120 from the waste chambers 210, 212.

The switch 100 may be operated as described above. By way of brief illustration, switch 100 is shown in a first state in FIG. 7 wherein the liquid switching element 180 makes a conductive path between contact pads 162 and 164. Drive element 202 (FIG. 2(*b*)) may be operated to effect a change in state of switch 100, as discussed above. Operation of the drive element 202 causes the liquid switching element 180 to move toward the other end of the main channel 120, wherein the liquid switching element 180 makes a conductive path between contact pads 160 and 162, as shown in FIG. 8. Drive element 200 (FIG. 2(*b*)) can be operated to change the state of the switch 100 back to the first state (FIG. 7).

It is readily apparent that switch 100 and production thereof according to the teachings of the present invention represents an important development in the field. The present invention allows for variance in the volume of liquid metal that is measured and delivered into the main channel 120. Excess liquid switching element 180 is removed into the waste chamber(s) 210, 212. Accordingly, the present invention corrects for volumetric errors that may be introduced during assembly of compact switching devices (e.g., LIMMS). For example, the present invention corrects volumetric errors resulting from the tolerance of the delivery tools. The present invention also corrects for volumetric errors resulting from variations in the dimensions of the main channel 120 itself.

Having herein set forth preferred embodiments of the present invention, it is anticipated that suitable modifications can be made thereto which will nonetheless remain within the scope of the present invention.

What is claimed is:

1. A switch, comprising:

a channel plate having a main channel and at least one waste chamber formed therein;

a substrate having at least one contact pad;

a liquid switching element deposited on said at least one contact pad, a portion of said liquid switching element isolated from the main channel into the at least one waste chamber when said channel plate was assembled to said substrate.

2. The switch of claim 1, wherein said channel plate further comprises a drive chamber connected to the main channel.

3. The switch of claim 1, further comprising a first waste chamber on one end of said main channel and a second waste chamber on another end of said main channel.

4. The switch of claim 1, further comprising at least one barrier on said channel plate, said at least one barrier isolating said liquid switching element between the at least one waste chamber and the main channel.

5. The switch of claim 1, further comprising at least one seal belt in the main channel of said channel plate, said liquid switching element wetting to said at least one seal belt.

6. The switch of claim 5, wherein said at least one seal belt extends between said main channel and said at least one waste chamber.

7. The switch of claim 5, wherein said at least one seal belt is positioned entirely within said main channel.

8. The switch of claim 5, wherein a first seal belt is positioned entirely within said main channel and a second seal belt extends between said main channel and said at least one waste chamber.

9. The switch of claim 1, wherein said liquid switching element is a liquid metal.

10. The switch of claim 1, wherein said liquid switching element is deposited as at least three volumes, two of the at least three volumes combining during assembly.

11. The switch of claim 1, wherein said liquid switch element is deposited as at least two volumes.

* * * * *

UNITED STATES PATENT AND TRADEMARK OFFICE

CERTIFICATE OF CORRECTION

PATENT NO. : 6,774,324 B2
DATED : August 10, 2004
INVENTOR(S) : Marvin Glenn Wong It is certified that error appears in the above-identified patent and that said Letters Patent is hereby corrected as shown below:

Column 8,
Line 15, after "liquid", delete "switch" and insert -- switching --

Signed and Sealed this

Seventh Day of December, 2004

JON W. DUDAS
*Director of the United States Patent and Trademark Office*